United States Patent [19]

Fujisawa

[11] 4,189,857

[45] Feb. 26, 1980

[54] DECORATIVE ARTICLE ASSEMBLY

[76] Inventor: Kenichi Fujisawa, No. 21, Kano, Yanagi-machi, Gifu City, Gifu Prefecture, Japan

[21] Appl. No.: 807,551

[22] Filed: Jun. 17, 1977

[51] Int. Cl.[2] ..... G09F 1/10

[52] U.S. Cl. ..... 40/158 R

[58] Field of Search ..... 40/152, 156, 160, 158 R

[56] References Cited

U.S. PATENT DOCUMENTS

| | | | |
|---|---|---|---|
| 481,217 | 8/1892 | Wiener | 40/152 |
| 599,774 | 5/1898 | Emmennegger | 40/152 |
| 751,518 | 2/1904 | Killion | 40/152 X |
| 782,199 | 2/1905 | Keplinger | 40/156 |
| 1,998,640 | 4/1935 | Shaw | 40/158 R |
| 2,195,985 | 4/1940 | Fox | 40/125 F |
| 2,968,109 | 1/1961 | Timmins | 40/152.1 |
| 3,230,651 | 1/1966 | Navarro | 40/124 |
| 3,965,599 | 6/1976 | Ebner | 40/124 X |
| 4,005,539 | 2/1977 | Chanberlain | 40/125 F |

*Primary Examiner*—Louis G. Mancene
*Assistant Examiner*—Wenceslao J. Contreras

[57] ABSTRACT

A decorative article in assembly with a decorative cover, including an inlay such as a tapestry or a photograph and preferably equipped with a stand, for use in the interior of a building comprises a plastic foam foundation, covered by a decorative covering with an informative inlay such as a photograph, a mirror, or a painting placed over the foundation and cover, the inlay being covered by a transparent sheet, the circumferential edge of the sheet being secured by a plurality of decorative pin heads, each pin head having its needle piercing through the sheet into the foundation for a tight fit of all the component parts.

1 Claim, 5 Drawing Figures

DECORATIVE ARTICLE ASSEMBLY

BACKGROUND OF THE INVENTION

The prior art articles of this type have different means for fixing the informative layer to different foundations, such as by inserting the photograph or the painting between transparent glass and the upper surface of the foundation, the transparent glass being held to the interior side of a square frame or by sealing the four corners of the photograph or the painting mounted on the foundation without securing or decorating the circumferential edge of the photograph or the painting itself. Moreover, it was not easy for the customer in general to freely produce the article of this type by simply changing the design according to his own taste.

SUMMARY

The first object of the present invention is to offer an interior decorative article utilizing its mounting elements to enhance the beauty of the inlay.

A second object of the present invention is to offer to a customer a package for the manufacture of the article to permit the mounting of the inlay and simultaneously to adopt any creative design he wishes.

Yet another object of the present invention is to offer a package permitting a simple alteration of the article of the invention, with which its design and the inlay can be freely changed.

Other objects and advantages of the present invention will become obvious from the following description referring to the accompanied drawings.

DETAILED DESCRIPTION OF THE INVENTION

Figure 1:
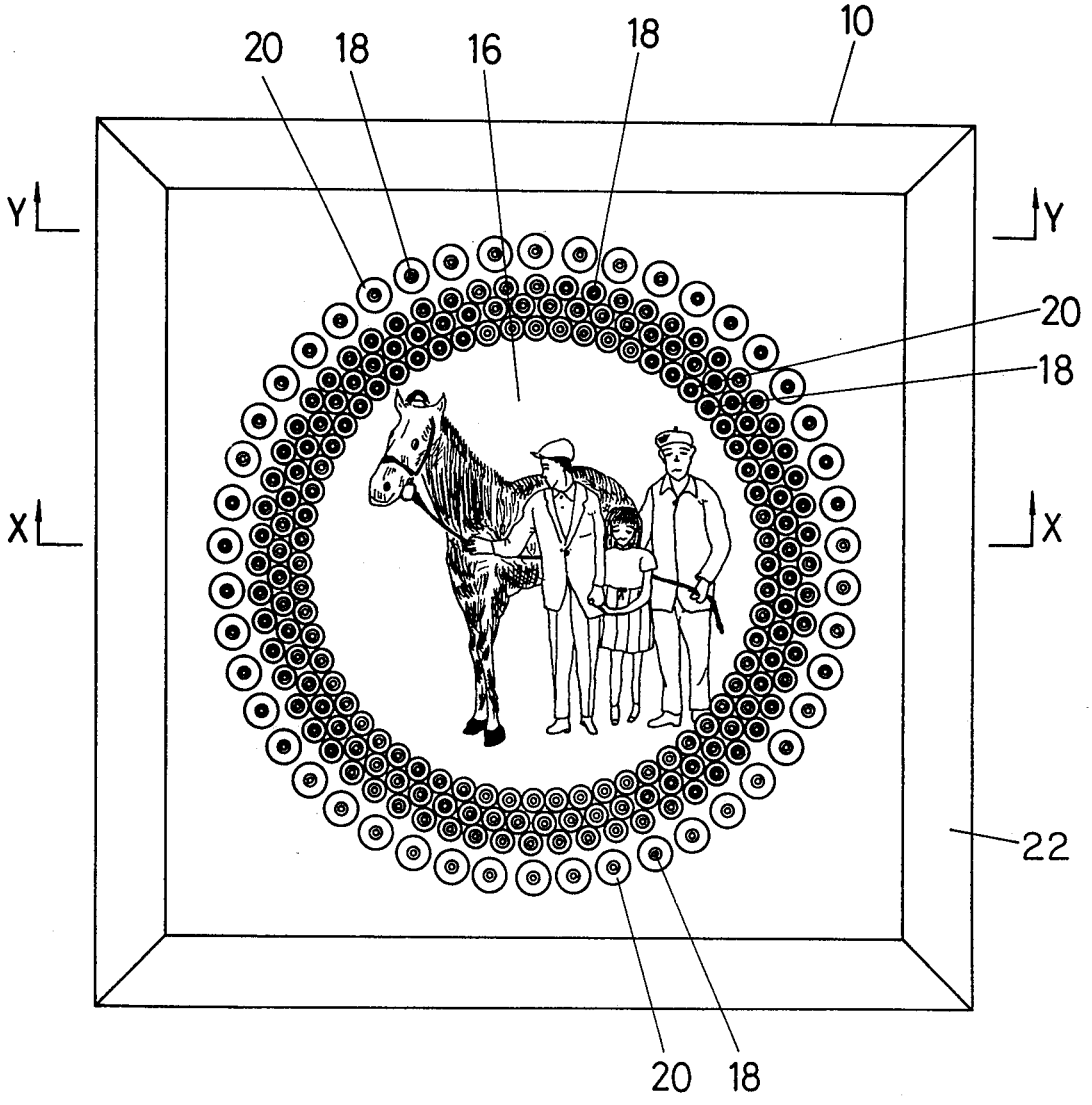
FIG. 1 is a front view of the article of the present invention.
Figure 2:
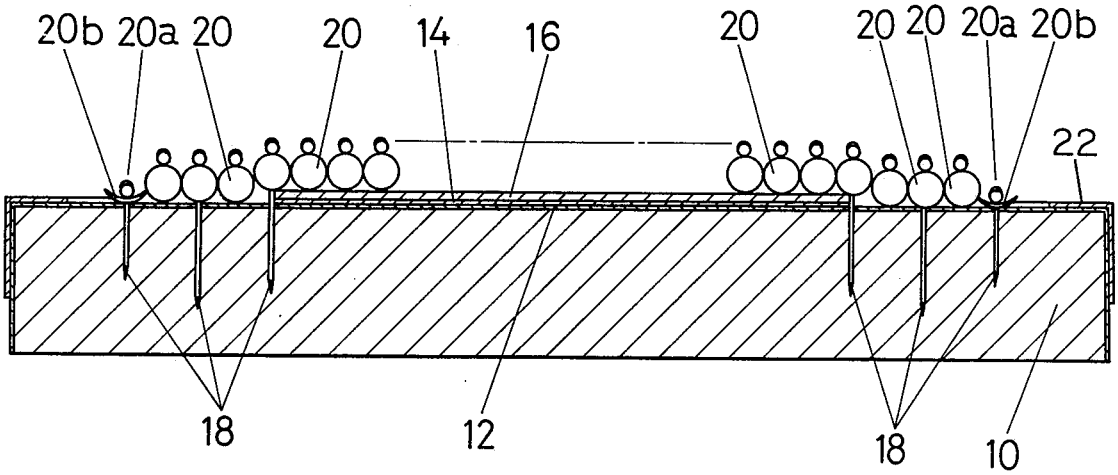
FIG. 2 is an enlarged view on Line X—X in FIG. 1.
Figure 3:
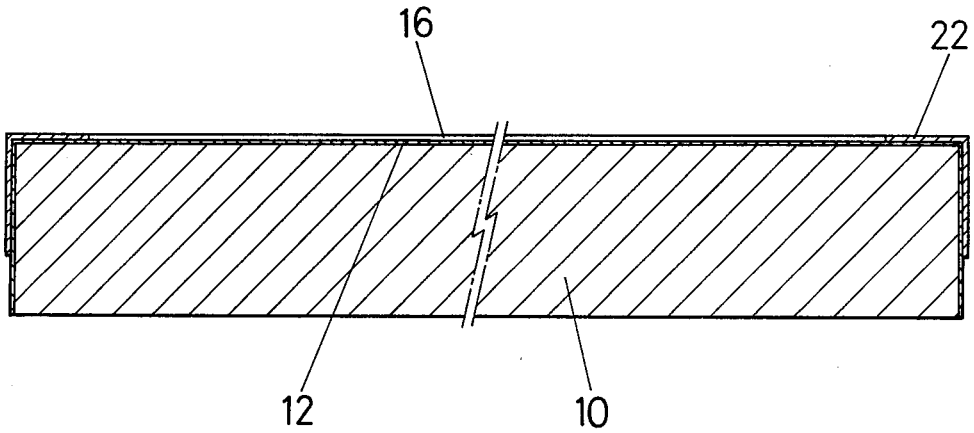
FIG. 3 is an enlarged sectional view on Line Y—Y in FIG. 1.

Referring to the accompanied drawings in which same reference numerals denote same or equivalent parts, there are shown in FIGS. 1 to 3, a foundation 10 of the decorative article, formed by plastic foam such as styrofoam, urethane foam, vinyle chloride foam, having properties permitting a pin to be thrust thereinto by hand. The shape of the foundation shown in the drawing is square, but it can be freely formed in any desired shapes. Since it is normally not desirable to employ plastic foam from the stand point of its aesthetic sense, a covering material 12 such as by coloring, a pattern, a cloth of velvet or a soft plastic sheet is put on its surface. Subsequently an inlay 14 such as a photograph or a painting is mounted at the center of the foundation, preferably leaving portions of the covering exposed, and a transparent sheet 16 such as glass, or a plastic sheet, is placed thereon. As shown on FIGS. 1, 2 and 3 a separate element in the shape of a frame extends over the foundation.

Figure 4:
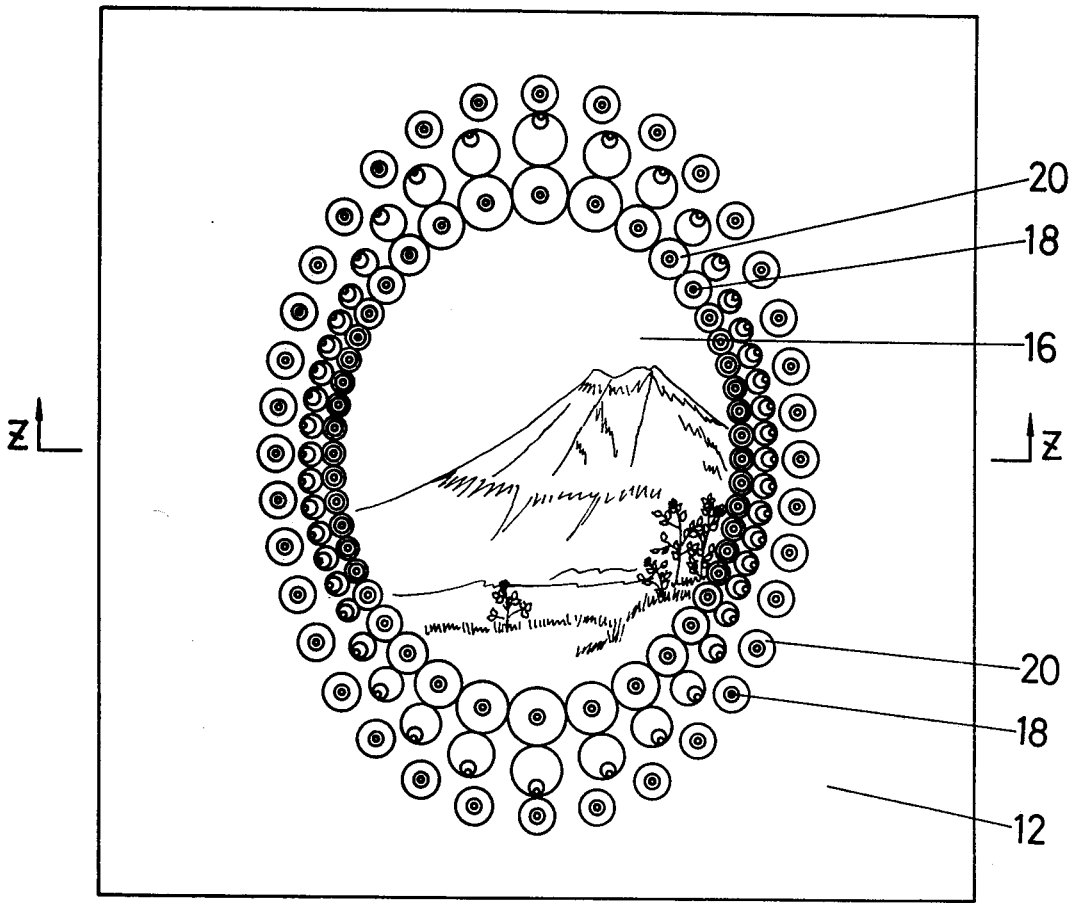
FIG. 4 is an enlarged front view of the principal part of another practical embodiment of this invention.
Figure 5:
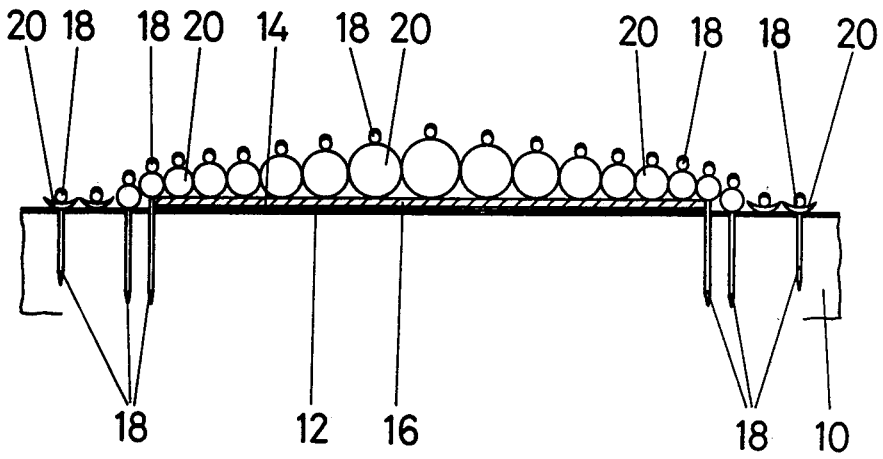
FIG. 5 is an enlarged sectional view on Line Z—Z in FIG. 4.

A plurality of decoration pins, each having a pin head 20 and a pin needle 18 is provided for the assembly of the article. The decoration pin 20 shown in the drawing is made of glass and has a design such as a pearl-shaped bead, a cornflower spangle, or other decorative design made of plastics, and the decoration may include, for instance, a small flower **20*b*, through which the pin needle is thrust. These pins are shown on FIGS. 2, 4 and 5 as pins 20*a*. In the process of assembly of the article the cover, which preferably is larger than the inlay, is placed over the foundation, the inlay positioned on top of the cover, preferably exposing a portion of the cover, a transparent sheet 16** is superimposed upon the inlay and the circumferential edges of the transparent sheet are secured onto the foundation by fitting a first set of pins, preferably decorative, to function around the edges. For promoting the esthetic character of the decoration article additional decoration pins may be pinned into the sheet on the outside of the plurality of the mounting pins; however, not necessarily for securing the transparent sheet. The additional decoration pins may serve only for decoration purposes and therefore, it is not always necessary to thrust them into the foundation around the circumferential edge of the transparent sheet.

The first set of pins **20*a* is disposed around the circumferential edge of the transparent sheet shown on FIGS. 1 and 2 and the pins preferably are of the same size, but are not restricted to the same size. As shown on the embodiment of FIGS. 4 and 5, the circumferential edge of the transparent sheet 16 can be freely fixed by the decoration pins of either a larger size or a medium one or a small one. In this embodiment again, the foundation is made of plastic foam same as in the first embodiment having the upper surface thereof colored or covered with a covering material 12. As shown on FIG. 2** the length of the pin is less than the thickness of the assembly.

Further, in the foregoing practical embodiment as an exemplary case, the transparent sheet 16 is employed and the photograph or the painting 14 is secured thereunder, however, a mirror or decoration glass, etc. may be also secured by a decoration pin 20.

The present invention being constructed as described in the foregoing, the transparent sheet, the mirror and the decoration glass on the foundation are secured by the decoration pins, and therefore, it is possible to obtain decoration articles of different designs, which process is not taught by the prior art. The decoration pin of the invention does not require any other parts for securing the assembly which could destroy its esthetic design, because it alone may secure the assembly with the transparent sheet, and it possesses its own decorative nature. Moreover, since thrusting of the needle into the foundation is employed not only for the decoration, but also for securing the transparent sheet, and additional pins function only for decoration purposes, the assembly is easy. The decoration pins can be freely arranged for decoration purposes so that interior decorative articles of different designs can easily be obtained. Furthermore, since the decoration pins can easily be pulled out from the foundation, other decoration articles of different designs can easily be created by utilizing the decoration pins which were withdrawn.

What is claimed is:

1. A decorative article package for assembly with at least one inlay, such as a tapestry, or a photograph, comprising:

a shaped foundation pierceable by a needle, such as made of plastic foam;

a covering material for said foundation conformingly shaped with said foundation;

a transparent sheet conformingly shaped with said foundation and having peripheral edges permitting a fixed assembly of said foundation with said cover and inlay in parallel adjoinment;

at least a first set of mounting pins, each having a preferably decorative head and a pin-needle, additional decorative pins, each having a decorative head, preferably of several sizes and configurations, and a frame conformingly shaped to extend over said foundation.

* * * * *